US005530050A

United States Patent [19]

Rangaswamy

[11] Patent Number: 5,530,050

[45] Date of Patent: Jun. 25, 1996

[54] THERMAL SPRAY ABRADABLE POWDER FOR VERY HIGH TEMPERATURE APPLICATIONS

[75] Inventor: Subramaniam Rangaswamy, Rochester Hills, Mich.

[73] Assignee: Sulzer Plasma Technik, Inc., Troy, Mich.

[21] Appl. No.: 223,907

[22] Filed: Apr. 6, 1994

[51] Int. Cl.[6] ..... C08J 5/10; C08K 31/18; C08K 3/22; C08L 79/08

[52] U.S. Cl. ..... 524/430; 523/204; 523/207; 523/209; 524/431; 524/404; 524/406; 524/413; 524/414

[58] Field of Search ..... 523/204, 207, 523/209; 524/404, 406, 413, 414, 436, 440, 441, 492, 493, 494, 430, 431

[56] References Cited

U.S. PATENT DOCUMENTS

| | | | |
|---|---|---|---|
| 2,742,224 | 4/1956 | Burhans | 230/122 |
| 3,508,955 | 4/1970 | Sliney | 117/119 |
| 3,689,971 | 9/1972 | Davidson | 29/156.8 CF |
| 3,836,156 | 9/1974 | Dunthorne | 277/53 |
| 4,063,742 | 12/1977 | Watkins, Jr. | 277/53 |
| 4,405,284 | 9/1983 | Albrecht et al. | 415/174 |
| 4,460,311 | 7/1984 | Trappmann et al. | 415/116 |
| 4,526,509 | 7/1985 | Gay, Jr. et al. | 415/174 |
| 4,599,270 | 7/1986 | Rangaswamy et al. | 428/402 |
| 4,652,209 | 3/1987 | Buddenbohm | 415/174 |
| 4,664,973 | 5/1987 | Otfinoski et al. | 428/307.3 |
| 4,669,955 | 6/1987 | Pellow | 415/174 |
| 4,671,735 | 6/1987 | Rossmann et al. | 415/172 A |
| 4,867,639 | 9/1989 | Strangman | 415/173.4 |
| 5,196,471 | 11/1990 | Rangaswamy et al. | 524/406 |
| 5,372,845 | 12/1994 | Rangaswamy | 427/216 |

*Primary Examiner*—Paul R. Michl
*Assistant Examiner*—U. K. Rajguru
*Attorney, Agent, or Firm*—Dykema Gossett

[57] ABSTRACT

Blended thermal spray powders are characterized by the presence of a $ZrO_2$ component and a ceramic coated plastic component. The ceramic coated plastic component is made by attrition milling ceramic fine particles with plastic core particles, causing the ceramic fine particles to bind to the surface of the plastic core without the use of a binder. Abradable coatings formed by thermal spraying the powders have superior high-temperature properties such as heat resistance and yet abrade readily to form abradable seals.

8 Claims, No Drawings

THERMAL SPRAY ABRADABLE POWDER FOR VERY HIGH TEMPERATURE APPLICATIONS

TECHNICAL FIELD

The present invention relates generally to composite abradable coatings which are fabricated using thermal spray processes. More specifically, this invention relates to composite abradable coatings for very high temperature applications.

BACKGROUND OF THE INVENTION

Materials which abrade readily in a controlled fashion are used in a number of applications, including as abradable seals. Very few thermal spray abradable coatings, however, are suitable for high-temperature applications. In general, contact between a rotating part and a fixed abradable seal causes the abradable material to erode in a configuration which closely mates with and conforms to the moving part at the region of contact. In other words, the moving part wears away a portion of the abradable seal so that the seal takes on a geometry which precisely fits the moving part, i.e., a close clearance gap. This effectively forms a seal having extremely close tolerances.

One particular application for abradable seals in high-temperature environments is their use in axial flow gas turbines. The rotating compressor or rotor of an axial flow gas turbine consists of a plurality of blades attached to a shaft which is mounted in a shroud. In operation, the shaft and blades rotate inside the shroud. The inner surface of the turbine shroud is most preferably coated with an abradable material. The initial placement of the shaft and blade assembly in the shroud is such that the blade tips are as close as possible to the abradable coating.

As will be appreciated by those skilled in the art, it is important to reduce back flow in axial flow gas turbines to maximize turbine efficiency. This is achieved by minimizing the clearance between the blade tips and the inner wall of the shroud. As the turbine blades rotate, however, they expand somewhat due to the heat which is generated. The tips of the rotating blades then contact the abradable material and carve precisely defined grooves in the coating without contacting the shroud itself. It will be understood that these grooves provide the exact clearance necessary to permit the blades to rotate at elevated temperatures and thus provide an essentially custom-fitted seal for the turbine.

In other gas turbines, the initial clearance is somewhat greater and the abradable coating is intended to protect the shroud and blade tips against wear during transient conditions (e.g., power surges).

In order for the turbine blades to cut grooves in the abradable coating, the material from which the coating is formed must abrade relatively easily without wearing down the blade tips. This requires a careful balance of materials in the coatings. In this environment, an abradable coating must also exhibit good resistance against particle erosion and other degradation at elevated temperatures. As known by those skilled in the art, however, few conventional thermal spray abradable coatings have the desired high-temperature performance characteristics.

A number of abradable coatings are known in the art. Limited success has been achieved by others with the use of $ZrO_2$ based ceramic coatings in abradable applications. $ZrO_2$ based powders have also been blended with plastic based powders, the blended mixture being plasma sprayed to form abradable coatings. These approaches, however, have produced coatings which exhibit limited abradability at high temperatures. In addition, the plastic powders tend to degrade during thermal spraying, producing inconsistent microstructures and inferior abradability.

Other conventional abradable coatings include such cellular or porous metallic structures as those illustrated in U.S. Pat. Nos. 3,689,971, 4,063,742, 4,526,509, 4,652,209, 4,664,973, and 4,671,735. Low melting point metallic coatings of indium, tin, cadmium, lead, zinc, and aluminum alloys have been suggested for use in providing "ablative" seals wherein heat generated by friction melts a clearance gap in the coating. This approached is exemplified in U.S. Pat. Nos. 2,742,224 and 3,836,156. Ceramics such as $ZrO_2$ and MgO for use in forming abradable coatings are also shown in U.S. Pat. Nos. 4,405,284, 4,460,311, and 4,669,955.

In U.S. Pat. Nos. 3,508,955, a composite material is disclosed which comprises a porous metal impregnated with a fluoride of metals selected from Groups I and II of the Periodic Table of the Elements. The use of fluoride salts and a barium fluoride-calcium fluoride eutectic is specifically mentioned as is the use of the material in bearings and seals. It is also disclosed therein that the resultant material can be sprayed with a surface layer of fluoride eutectic slurry which is then dried and sintered.

In U.S. Pat. No. 4,867,639, abradable coatings for use in turbine or compressor shrouds are disclosed which are described as low melting fluoride compounds such as $BaF_2$, $CaF_2$ and $MgF_2$ incorporated into a higher melting temperature ceramic or metallic matrix. It is disclosed that, alternatively, the soft ceramic phase may be used to fill or impregnate a honeycomb shroud lining made of the higher melting temperature ceramic or metal alloy, so that the soft ceramic is not eroded by hot gases in the turbine. Zirconia and/or alumina are disclosed as the preferred high melting temperature ceramic, and NiCr and NiCrAl are disclosed as preferred metals.

The use of metal matrix coatings having a plastic component such as a polyimide are also known for use in forming an abradable seal in high-efficiency compressors. Due to the lower temperatures generated in the compressor and the fact that the rotating blades are generally softer than those found in the turbine section, plastics have been used in lieu of solid lubricants such as $CaF_2$. While the lower melting point of plastics is advantageous in such low temperature applications, the use of these coatings has not been successful in high temperature applications.

In U.S. Pat. No. 5,196,471, "Thermal Spray Powders for Abradable Coatings Containing Solid Lubricants and Methods of Fabricating Abradable Coatings," thermal spray powders are described which are characterized by the presence of a matrix-forming component, a solid lubricant component and a plastic component. Abradable coatings formed by thermal spraying the powders abrade readily to form abradable seals. The abradable coatings have a metal, metal alloy, or ceramic matrix with discrete inclusions of solid lubricant and plastic. Therein, the use of Zirconia is described as a preferred ceramic for use as the matrix-forming component.

Therefore, it would be desirable to provide a composite material which abrades readily at high temperatures without producing significant wear of rotating parts.

It would also be desirable to provide such a material which can be fabricated using conventional thermal spray techniques.

It would still further be desirable to provide a coating for forming abradable seals which can be custom formulated for a particular operating environment.

The present invention achieves these goals by providing thermal spray powders which are a two component blended mixture that forms high-temperature, abradable coatings by conventional thermal spray application.

SUMMARY OF THE INVENTION

In one aspect, the present invention provides a two component, blended powder. The first component is a $ZrO_2$ based ceramic powder, preferably fully or partially stabilized $ZrO_2$. The stabilizing oxide is preferably CaO, MgO, $Y_2O_3$, $CsO_2$ or combinations thereof. The second component is a plastic-ceramic composite. Plastic forms the core of the particle. The plastic core is coated with fine ceramic particles. The ceramic is preferably either a $ZrO_2$ based material or a solid lubricant material. The second component is formed in an attrition mill.

The first and second components are mechanically blended into a mixture. The weight percentage of the second component generally does not exceed 50% of the thermal spray blend.

In another aspect of the present invention, the blended powder of the present invention is applied through the use of a thermal spray device to form an abradable coating which maintains superior properties at high temperatures.

DETAILED DESCRIPTION OF THE PREFERRED EMBODIMENTS

In one embodiment, the present invention provides blended thermal spray powders for use in forming high-temperature abradable materials such as coatings for turbine shrouds, compressor housings and other applications in which it is necessary to form an abradable seal that is subjected to high temperatures.

The thermal spray powders of the invention are a blend of two powders. The first powder or component is a $ZrO_2$ ceramic powder. Preferably, the $ZrO_2$ is fully or partially stabilized. Suitable stabilizing oxides are selected from the group consisting of CaO, MgO, $Y_2O_3$ and $CsO_2$ and combinations thereof. Most preferred for use in the present invention is $ZrO_2$ stabilized with yttrium oxide. The weight percentage of the stabilizing oxide will typically be between 4% and 30%, all percentages herein being by weight unless otherwise indicated.

Methods of forming stabilized $ZrO_2$ powders for use in the present invention will be known to those skilled in the art. These include conventional methods such as spray drying, spray drying and densifying, spray drying with sintering and fused/crushed techniques. Other methods may be suitable or preferred for a given application.

The first component preferably has an average particle size of from about 5 μm to about 150 μm, with particles ranging in size from about 0.1 μm to about 200 μm, and more preferably an average size of from about 10 μm to about 100 with particles ranging in size from about 1 μm to about 125 μm. In terms of mesh size, the size distribution of the stabilized $ZrO_2$ component is preferably 140 mesh and below.

The stabilized $ZrO_2$ component of the blended thermal spray powders of the present invention preferably comprises from about 50 to about 99 percent by weight of the total blended powder weight.

The second powder or component of the blended thermal spray powders of the present invention is a plastic-ceramic composite particle. The plastic component forms the core of the particle and is coated with fine ceramic particles.

The plastic which forms the particle core is most preferably a thermoplastic, although it is anticipated that thermosetting plastics may be suitable in some applications. The preferred plastics should withstand temperatures at least up to 250° F. without changes. It is believed that a broad range of molecular weights will be suitable. It is estimated that the weight average molecular weight of suitable plastics may range from approximately 500 to 1,000,000, and other values may also be suitable in some instances.

Among the preferred plastics are polyimides such as those described in U.S. Pat. Nos. 3,238,181, 3,426,098, 3,382,203, the disclosures of which are incorporated herein by reference, most preferably thermoplastic polyimides, polyamide-imides, polyetherimides, bismalemides, fluoroplastics such as PTFE (polytetrafluoroethylene), FEP (fluorinated ethylene-propylene) and PFA (perfluoroalkoxy), ketone-based resins, also polyphenylene sulfide, polybenzimidazole aromatic polyesters, and liquid crystal polymers. Also preferred are imidized aromatic polyimide polymers and p-oxybenzoyl homopolyester such as disclosed in U.S. Pat. No. 3,829,406 and poly(para-oxybenzoylmethyl) ester. Plastics sold under the trademarks Torlon™ and Ekonol™ and Lucite™ are also preferred.

The plastic core particles preferably have an average particle size of from about 5 μm to about 150 μm; with particles ranging in size from about 0.1 μm to about 200 μm, and mare preferably an average size of from about 10 μm to about 100 μm, with particles ranging in size from about 1 μm to about 125 μm. In terms of mesh size the plastic core particles are preferably −100 mesh.

The plastic-ceramic particles which form the second component of the present invention are formed as stated, by coating the plastic core with fine particles of the ceramic. The ceramic fine particles may be selected from the group consisting of stablized or unstablized $ZrO_2$, hexagonal boron nitride, CaO, MgO, phosphates, $Y_2O_3$, $CeO_2$, silicates, glasses, and combinations thereof. Most preferred are fully or partially stabilized $ZrO_2$ and hexagonal boron nitride.

The ceramic fine particles preferably have an average particle size of from about 0.1 μm to about 20 μm, with particles ranging in size from about 0.1 μm to about 30 μm, and more preferably an average size of from about 1 μm to about 10 μm, with particles ranging in size from about 1 μm to about 20 μm. Referring to mesh size, the size distribution of the stabilized $ZrO_2$ component is preferably below 325 mesh.

As a percentage of the weight of the plastic-ceramic particles, the plastic or core component is preferably from about 80 to about 99 percent by weight,, and more preferably from about 85 to about 97 percent by weight and the ceramic coating is preferably from about 1 to about 20 percent and more preferably from about 3 to about 15 of the plastic-ceramic particles.

The preferred method of making the plastic-ceramic composite particles which are used in the powder blend of the present invention is an attrition milling technique in accordance with the disclosure set forth in U.S. patent application Ser. No. 07/847,554 filed Mar. 6, 1992, entitled "Improved Method For Preparing Binder-Free Clad Particles" which is assigned to the assignee of the present invention and the entire disclosure of which is incorporated herein. Therein, a method of attaching ceramic particles, which may include brittle ceramics such as hexagonal boron nitride, to a more malleable material, such as metal are described. In the present invention this same process is carried out using plastic as the malleable material which forms the core of the particle. Thus, the preferred method of forming the ceramic coated particles of the present invention is mechanical attachment without the use of a binder. The ceramic particles are preferably partially embedded in the surface of the plastic core. In more detail, the plastic core particles and the fine ceramic particles are placed in the drum of an attritor along with grinding balls. The materials are processed in the attritor for a period sufficient to form a binderless clad powder, but where the particle size of the plastic component is essentially unchanged during the processing, and wherein the ceramic-plastic particles consist essentially of the plastic core of the powder and the ceramic fine particles coating the surface of the core. The powder is then collected, and classified if necessary. Other methods for attaching the fine ceramic particle to the plastic core may be suitable in some applications.

Attachment of the fine ceramic particles to the plastic core results in the production of a ceramic coated plastic particle which, as stated, forms one component of the blend of the present invention. On average, plastic comprises from about 80 percent to about 99 percent of the weight of the ceramic coated plastic particle, and more preferably from about 85 percent to about 97 percent. Accordingly, ceramic comprises from about 1 to about 20 percent by weight of the ceramic coated plastic particle and more preferably from about 3 to about 15 percent by weight of the ceramic coated plastic particle. The ceramic coated plastic particles preferably range in size from about 0.1 μm to about 200 μm, with an average particle size of from about 5 μm to about 150 μm. More preferably, the ceramic coated plastic particles of the present invention range in size from about 1 μm to about 125 μm, with an average particle size of from about 10 μm to about 100 μm. In terms of mesh size the most preferred particle size is below 100 mesh.

After the preparation of the first and second components of the inventive powder blend, i.e. the $ZrO_2$ powder and the plastic ceramic coated particles, the two powders are combined to form a powder blend. The powders are blended together mechanically using any of a number of mixers which mix the powders without substantially breaking apart the individual particles. The ceramic coated plastic component constitutes up to about 50% by weight of the total weight of the powder blend; in other words, up to about 50% by weight of the thermal spray powder of the present invention is ceramic coated plastic. More preferably, the ceramic coated plastic component comprises from about 1.0% to about 50% by weight and the $ZrO_2$ component forms from about 50% to about 99% of the total weight of the final thermal spray powder blend. Most preferably, the ceramic coated plastic component constitutes about 1 to 20 percent by weight and the $ZrO_2$ component constitutes about 80 to about 99 percent by weight of the final thermal spray powder.

A number of thermal spray devices and techniques can be used to form the abradable coatings of the present invention. It is contemplated that in most applications the powder blend will be sprayed, i.e., the powder blend will be introduced into the spray stream from a single feeder; it may be desirable, however, to add the first or second components to the spray stream independently using two separate feeders or to simultaneously spray the first component using one spray gun and the second component using another spray gun, with the two spray streams intersecting before or at the target.

By way of illustration only, a thermal spray powder having the characteristics described herein, in which the plastic is aromatic polyester, the ceramic coating of the plastic particle is hexagonal BN, and $ZrO_2$ constitutes about 95 percent of the total weight of the blend, would be preferably thermal sprayed at a feed rate of about 20 to 70 g/min.

The particles may be sprayed using parameters suitable for the specific spray system. Parameters using the Metco 7MB gun for this powder are showed in this table.

| | | |
|---|---|---|
| Gun | | 7MB |
| Plasma Gases | | Argon-Hydrogen |
| Nozzle | | G |
| Powder Injector | | #2 |
| Gases: | Pressure | Flow |
| Primary | 50 | 72 Ar |
| Secondary | 50 | 12 $H_2$ |
| Carrier | 50 | 40 Ar |
| Current (Amps) | | 460 |
| Voltage (V) | | approx. 77 |
| Spray rate (lbs/hr) | | 12 |
| Spray distance (inches) | | 4.5 |

*As a starting point, adjust to indicated spray rate

The spray parameters must be compatible with the characteristics of the thermal spray powders as well as sufficient to provide a final coating as described herein. The conditions are such that none of the components substantially thermally degrade or vaporize during spraying. The components should also not segregate in the resultant coating, i.e., they should be generally randomly dispersed. In use, the coatings of the present invention most preferably serve as abradable seals in high-temperature applications, although numerous other applications will be apparent to those skilled in the art.

In some instances, it may be advantageous for the plastic component of the coating to be removed by thermal treatment prior to service or by thermal exposure in service.

A number of specific coatings (and thermal spray powders used to form the coatings) are provided by the present invention which are deemed particularly useful in forming abradable coatings. More specifically, the following combinations are particularly preferred (all percents by weight of powder:

| Stablized $ZrO_2$ | coating ceramic (BN) | Plastic (Aromatic Polyester) |
|---|---|---|
| 95% | 0.625% | 4.375% |
| 96% | 0.5% | 3.5% |

What is claimed is:

1. A blended thermal spray powder, consisting essentially of a blend of $ZrO_2$ particles and particles consisting essentially of a plastic core material coated with a ceramic material, wherein said ceramic coated plastic particles are formed by attrition milling ceramic fine particles and a plastic core for a period sufficient to bond said ceramic fine particles to said plastic core without substantially reducing the size of said plastic core.

2. The thermal spray powder recited in claim 1, wherein said $ZrO_2$ is fully or partially stabilized with an oxide selected from the group consisting of CaO, MgO, $Y_2O_3$, $CeO_2$ and combinations thereof.

3. The thermal spray powder recited in claim 1, wherein said ceramic coating of said ceramic coated plastic is selected from the group consisting of hexagonal boron nitride, $ZrO_2$, CaO, MgO, $CO_2$, $Y_2O_3$ phosphates, silicates and glasses, combinations thereof.

4. The thermal spray powder recited in claim 1, wherein said plastic is a thermoplastic.

5. The thermal spray powder recited in claim 1, wherein said plastic is a thermoset.

6. The thermal spray powder recited in claim 1, wherein said plastic is selected from the group consisting of polyimides, polyamide-imides, polyetherimides, bismalemides, fluroplastics, liquid crystal polymers, and ketone based resins and combinations thereof.

7. The thermal spray powder recited in claim 1, wherein up to 50% by weight of said thermal spray powder is said ceramic coated plastic.

8. The thermal spray powder recited in claim 1, wherein said ceramic coated plastic forms from about 1.0% to about 50% by weight of said thermal spray powder.

* * * * *